United States Patent [19]

Yonezawa

[11] 4,042,311

[45] Aug. 16, 1977

[54] PUMP FLUID MOTOR CARRYING SPOOL VALVE FOR DISTRIBUTOR VALVE ACTUATION

[75] Inventor: Keitaro Yonezawa, Amagasakishi, Japan

[73] Assignee: Aioi Seiki Kabushiki Kaisha, Japan

[21] Appl. No.: 661,549

[22] Filed: Feb. 26, 1976

[30] Foreign Application Priority Data

Mar. 8, 1975 Japan ..... 50-28210

[51] Int. Cl.[2] ..... F04B 17/00; F04B 35/00; F01L 25/06

[52] U.S. Cl. ..... 417/401; 91/287; 91/309

[58] Field of Search ..... 417/398, 401, 392, 402; 91/309, 287, 303, 307

[56] References Cited

U.S. PATENT DOCUMENTS

| | | | |
|---|---|---|---|
| 923,486 | 6/1909 | Bowen | 91/309 |
| 3,071,118 | 1/1963 | Wilden | 91/307 |
| 3,726,185 | 4/1973 | Orr | 91/303 |
| 3,963,383 | 6/1976 | Hill | 91/309 |

*Primary Examiner*—Carlton R. Croyle
*Assistant Examiner*—Thomas I. Ross
*Attorney, Agent, or Firm*—Bacon & Thomas

[57] ABSTRACT

A pressure fluid engine of single acting cylinder type has a directional control valve and a master valve with a spool and two valve seats. The spool is formed on a piston rod extending from a piston in the cylinder, the rod passing through a cylindrical disc of the directional control valve. One of the valve seats is provided in the disc to unseal the pilot operating fluid when it cooperates with the spool at a dead point. Another valve seat for the spool is provided in one of the valve chambers of the directional control valve to unseal the pilot operating fluid when it cooperates with the spool at the other dead point. The directional control valve is actuated by means of directional control of a pilot operating fluid with the master valve, in order to reverse the direction of the piston when the piston reaches one of the dead points.

7 Claims, 5 Drawing Figures

PUMP FLUID MOTOR CARRYING SPOOL VALVE FOR DISTRIBUTOR VALVE ACTUATION

BACKGROUND OF THE INVENTION

The present invention relates to a pressure fluid engine which converts the pressure energy of the operating fluid, such as compressed air, pressure liquid, to a reciprocating actuation by means of a single acting cylinder therein.

A pressure fluid engine of the above mentioned type is already known. The pressure fluid engine of the prior art is provided with a directional control valve which connects a cylinder chamber of a single acting cylinder to either an inlet or an outlet, both for the operating fluid, such as compressed air. The air goes into and out of the cylinder chamber to actuate a piston in the cylinder. The unit is also provided with a means for operating the directional control valve, which cooperates with the piston in the cylinder, and which structure is relatively complicated. Accordingly, the pressure fluid engine of the prior art mentioned above has disadvantages in its operating speed, assembly, and maintenance. Moreover, the operation of the engine is often interrupted by the stopping of the means for operating the directional control valve at extremely slow speeds. Thus, the unit stops completely.

SUMMARY OF THE INVENTION

Accordingly, it is a primary object of the invention to remedy the disadvantages mentioned above with means, including a directional control valve and a master valve for the operation of the direction control valve. The construction of the control means is relatively simple.

In order to implement these and still further objects of the invention which will become more readily apparent as the description proceeds, the inventive pressure fluid engine comprises a spool on the master valve formed on a piston rod in a single acting cylinder. The spool is inserted through a hole drilled through a disc of a directional control valve, wherein one of a pair of valve seats of the master valve is provided. Another valve seat of the master valve is provided in the valve chamber of the directional control valve. One of the valve seats is operated to seal the pilot operating fluid for the directional control valve with the piston rod while the other is operated to unseal it and the spool when the spool is positioned on any one of its dead points. The one seat is operated to unseal it and the spool, while the other is operated to seal it with the piston rod when the spool is positioned on the opposite dead point. Therefore, either the upper or the lower valve chamber of the directional control valve is connected to an outlet for the operating fluid by way of a passage through the disc of the directional control valve. The mating chamber is connected to an inlet of the operating fluid. As a result, the disc is moved to change the actuation of the piston in the reverse direction when the spool reaches one of its dead points.

According to a preferred aspect of the present invention, the valve seat provided in the valve chamber of the directional control valve moves from the sealed position to the unsealed position along the spool when the spool is positioned on any one of the dead points. Thus, there is quick actuation of the disc to change the direction of the operating fluid at the end of the stroke of the spool to increase the operating speed of the engine.

According to another preferred aspect of the present invention, the movable valve seat is forced to move from the sealed position to the unsealed position by means of the pilot operating fluid. Therefore, it is more advantageous for the operation at higher speeds to accurately effect the actuation of the valve seat.

BRIEF DESCRIPTION OF THE DRAWINGS

The present invention will be better understood and additional objects will become apparent when consideration is given to the following detailed description thereof and the accompanying drawings wherein.

DETAILED DESCRIPTION OF THE PREFERRED EMBODIMENTS

Figure 2:
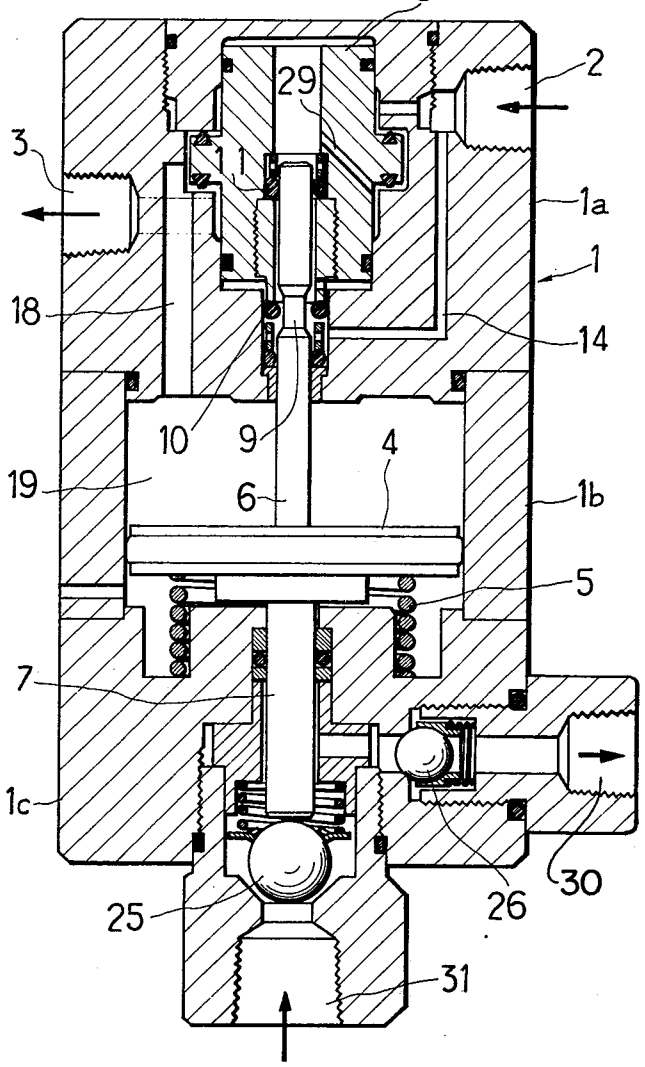
FIG. 1 and FIG. 2 are vertical section views of a preferred embodiment in two operating positions.
Figure 1:
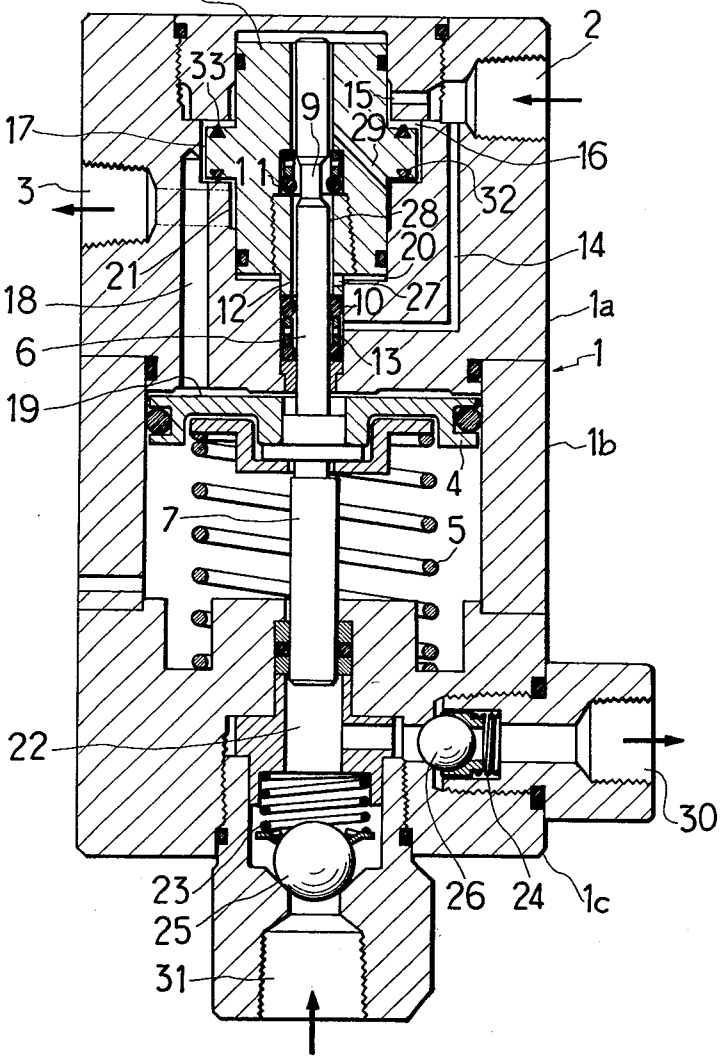

FIG. 1 and FIG. 2 show vertical sections of a pneumatic hydraulic converter. The reference number 1 indicates a casing generally including block 1*a*, a cylinder tube 1*b*, and a hydraulic unit casing 1*c*. Elements 1*a*, 1*b* and 1*c* are connected together by conventional tie rods (not shown).

An inlet 2 and an outlet 3 to receive and discharge the operating compressed air are provided in the control block 1*a*. A piston 4 and a spring 5 are inserted in the cylinder tube 1*b*. A piston rod 6 extending upwardly from the piston 4 is inserted inside the control block 1*a*, and a plunger 7 for the hydraulic unit extends downwardly from the piston 4.

In the control block 1*a*, a cylindrical disc 8 for directional control of the operating air is movable upwardly and downwardly within a given range. A master spool 9 for the control of the disc actuation is formed in the mid-portion of the piston rod 6 as a circular groove. An O-ring 10 is provided below the valve chamber in which the disc 8 is inserted. The O-ring 10 is placed around the piston rod 6 as a valve seat for the spool 9. Another O-ring 11 is provided in an opening drilled through the disc 8 as another valve seat for the spool 9. The lower O-ring 10 is supported by a projection 12 extending from the bottom of the disc 8. The space 13 under the O-ring 10 formed between the control block 1*a* and the piston rod 6 is connected with the inlet 2 by a passage 14 communicating with the inlet 2.

When the piston rod 6 is positioned at the upper dead point as shown in FIG. 1, the compressed air delivered through the inlet 2 goes into an upper valve chamber 16 to push the disc 8 downward by way of a space 15 formed between the control block 1*a* and the upper part of the disc 8. The operating air then goes into a cylinder chamber 19 through the space 15, valve chamber 16, another space 17 formed between the control block 1*a* and the middle portion of the disc 8, and a passage 18 to push the piston 4 downward against the spring 5.

When the piston rod 6 is positioned at the lower dead point as shown in FIG. 2, the compressed air passes into lower valve chamber 20 through the passage 14 to push the disc 8 upward. Then, the operating air in the cylinder chamber 19 passes out the inlet 3 through the passage 18, the space 17 and another space 21 formed between the control block 1*a* and the lower portion of the disc 8; and the piston 4 is lifted upwardly by the spring 5.

Also, the hydraulic unit of the known plunger type has a hydraulic chamber 22 into which plunger 7 reciprocates and a pair of check valves including balls 25 and 26 which are pressed into their respective valve seats by a pair of springs 23 and 24.

The detailed explanation of the operation of the pneumatic hydraulic converter described above, particularly on actuation with compressed air engine, will be described below.

FIG. 1 shows the condition of the engine when the piston 4 is at the start of its descent. The disc 8 of the directional control valve is descended downwardly upon receiving the pressure of operating air in the upper valve chamber 16. The upper O-ring 11 is unsealed so that the lower valve chamber 20 is connected to the outlet 3 by way of a hole 27 drilled through the projection 12 of the disc 8, the passage 28 which connects the inside and outside of the disc 8, and the space 21. Thus, the disc 8 moves downwardly without resistance. After the descent of the disc 8, the piston 4 is actuated by the operating air coming into the cylinder chamber 19 through the passage 18 to descend, resulting in the hydraulic oil pushed out from the outlet port 30 of the hydraulic unit. The other O-ring 10 is kept sealed by the air, pushed by the projection 12 of the disc 8 in the space between the piston rod 6 and the block 1*a*.

FIG. 2 shows the condition of the engine when the piston is about to start the ascent. The lower O-ring 10 is changed to an unsealed position relative to the spool 9, and the upper O-ring is in contact with the piston rod 6 for sealing. Thus, the compressed air is lead to both valve chambers 16 and 20. The effective area on the disc 8 to cause it to ascend by the pressure is larger than that of the disc 8 to descend in order to lift the disc 8 as shown in FIG. 2, and in order to accordingly connect the cylinder chamber 19 with the outlet 3. The piston 4 is caused to ascend by the spring 5, and the oil is drawn in from the suction port 31 of the hydraulic unit.

Thus, the cyclic reciprocating actuation of the compressed air engine will be repeated in the same manner. During the actuation, when the load on the plunger 7 is balanced with the pressure of the air acting on the piston 4, the actuation will become extremely slow. Accordingly, the sealing by the piston rod 6 and O-ring 10, for example, will become extremely slow to change to the unsealed position. If the disc 8 is lifted a small distance by the lifting pressure of the air in the lower valve chamber 20, which is more powerful than the descending pressure of the air in the upper valve chamber 16, the poppet 32 is slightly lifted from the valve seat. At this time the disc is suspended in the neutral position, and the upper poppet 33 of the disc 8 is not in contact with the valve seat and the lower poppet 32 is lifted off the valve seat. In this embodiment of the present invention, the lower O-ring 10 is able to move upward with the projection 12 of the disc 8 and the O-ring 10 is forced to ascend by the pressure of the air coming into the space 13 through the branched passage 14. Accordingly, the O-ring 10 is forced to move to the unsealed position, and the passage to feed compressed air into the lower valve chamber 20 is opened to raise the disc 8 quickly without delay until the upper poppet 33 is in contact with the valve seat. In the ascent of the piston 4, the speed is sufficiently high because it is moved by the repulsion of the spring. If the disc 8 is caused to suspend for any reason, the upper O-ring 11 in contact with the piston rod 6 moves down to face with the spool 9, and the lower valve chamber 20 is immediately connected with the outlet 3 to descend the disc 8.

Figure 3:
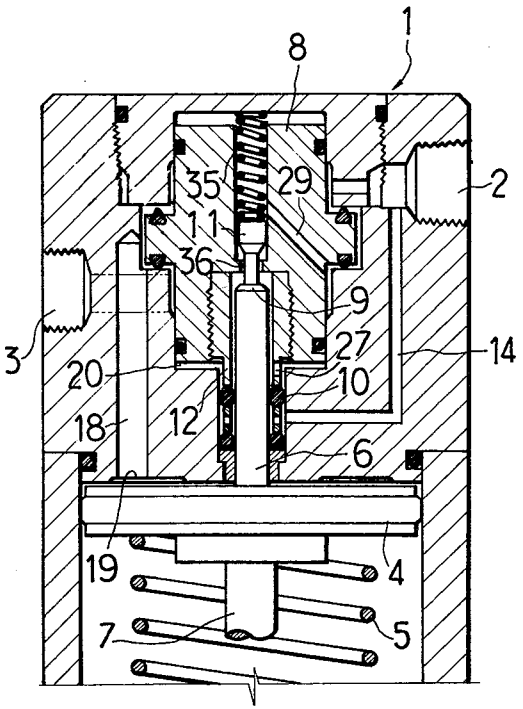

FIG. 3 shows another embodiment of the present invention wherein the pressed air engine is preferably combined with a hydraulic unit. The structure of upper sealing of the master valve includes a small disc 11' on rod 6 instead of the upper O-ring 11 of the foregoing embodiment. The disc 11' is biased into contact with a fixed valve seat by a spring 35, and pushed up by the spool 9 to open the passage. This engine is operated in the same manner as the foregoing embodiment of the invention.

Figure 4:
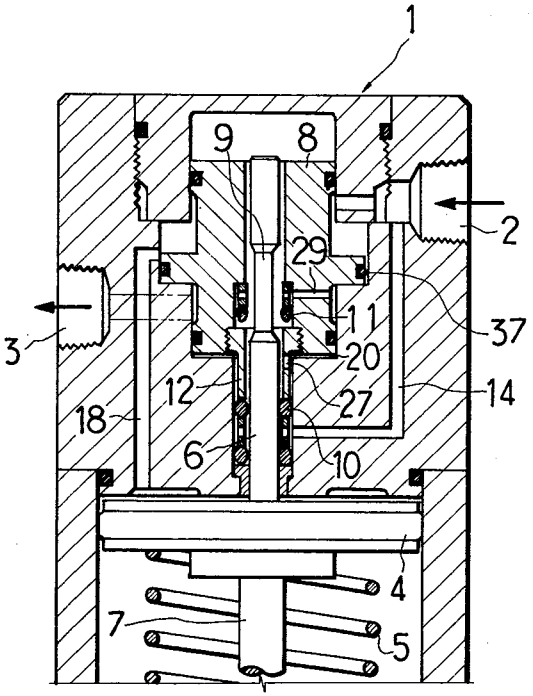

A compressed air engine shown in FIG. 4 is different from the first described embodiment in that a ring seal 37 is provided around the disc 8 instead of the two poppets 32 and 33.

Figure 5:
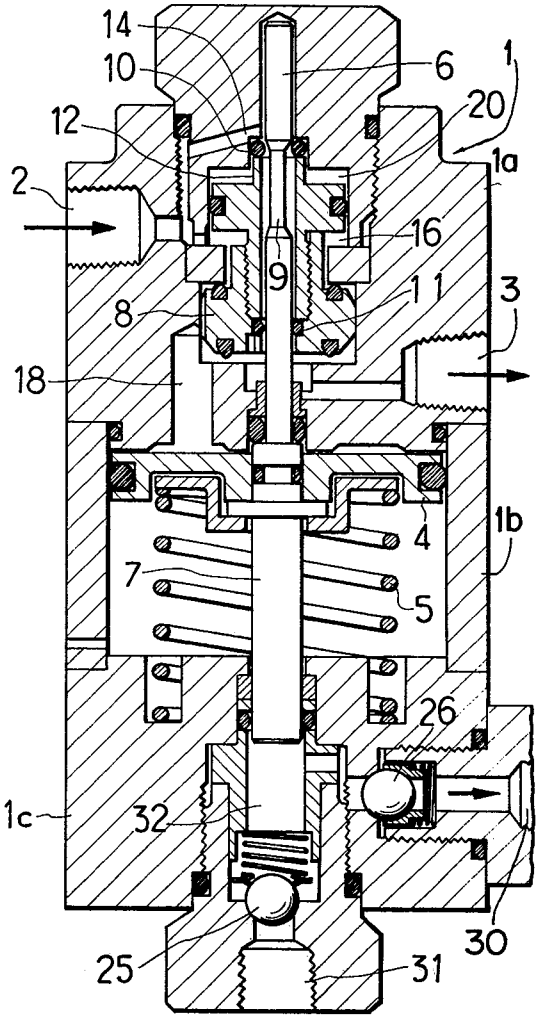
FIG. 3, FIG. 4, and FIG. 5 are vertical section views of alternative embodiments.

A compressed air engine shown in FIG. 5 is different from the first described embodiment in that the movable O-ring 10 is provided over the upper valve chamber 16 and held by the projection 12 of the disc 8. The projection extends upwardly from the disc, and the O-ring 10 separates from the projection 12 to unseal the pilot operating air.

It will be easily understood that the present invention is applicable with a hydraulic intensifier, pneumatic intensifier, pneumatic rivetter, pneumatic hammer, etc., without departing from the scope and spirit in the claims.

I claim:

1. In a fluid engine having a single acting cylinder for converting the pressure energy of an operating fluid to reciprocating actuation of a piston in a cylinder chamber, a directional control valve which alternately connects the cylinder chamber to an operating fluid inlet port, to force the piston downward by the pressure of the operating fluid against a spring biasing force, and to an operating fluid outlet, to permit return of the piston upwardly by the spring biasing force, and a master valve to operate the directional control valve, the improvement comprising:

a. a piston rod on said piston, b. a spool on said piston rod, c. a reciprocably movable disc comprising said control valve, and said piston rod passing through said disc, and d. a pair of valve seats in said master valve additionally forming packings, one of said valve seats being in said disc and the other exterior of said disc, said pair of valve seats cooperating with said piston rod and its spool to alternately perform simultaneous respective sealing and unsealing of operating fluid to effect a reciprocation of the disc, thereby either permitting operating fluid to enter the cylinder chamber or venting operating fluid from the cylinder chamber, so as to cause movement of said piston.

2. An engine as defined in claim 1 wherein said spool is movable from an end position adjacent one of said valve seats to a position adjacent the other of said valve seats.

3. An engine as defined in claim 1 including an upper valve chamber on one side disc and a lower valve chamber on the other side of said disc wherein the operating fluid alternately acts on said chambers to cause reciprocation of said disc and said piston.

4. An engine as defined in claim 3, wherein one of said valve seats provided adjacent one of said chambers is movable between a sealing position and an unsealing position as said piston rod and spool are moved from one end point to the other.

5. An engine as defined in claim 4 wherein said valve seat adjacent one of said chambers is in the unsealed position when said piston rod is in the lower position.

6. An engine as defined in claim 3, including a pair of poppet valves positioned on opposite sides of said disc, and respectively cooperating with a pair of opposed walls of one of said valve chambers.

7. An engine as defined in claim 1, including a plunger extending from said piston, said plunger reciprocating in and out of a hydraulic chamber, said hydraulic chamber having inlet and outlet valved ports arranged whereby the reciprocation of said plunger causes fluid to be sucked in the inlet port on an upward movement, and out the outlet port on a downward movement.

* * * * *